US005983695A

United States Patent [19]

Lutz

[11] Patent Number: 5,983,695

[45] Date of Patent: Nov. 16, 1999

[54] METHOD OF MANUFACTURING A CORRUGATED METALLIC PIPE AND CORRUGATED PIPE PRODUCED BY THE METHOD

[75] Inventor: Christian Lutz, Nüziders, Austria

[73] Assignee: Etablissement Supervis, Vaduz, Liechtenstein

[21] Appl. No.: 09/084,255

[22] Filed: Feb. 12, 1998

Related U.S. Application Data

[63] Continuation-in-part of application No. 08/694,018, Aug. 8, 1996, abandoned.

[51] Int. Cl.[6] ..... B21D 15/06

[52] U.S. Cl. ..... 72/370.19

[58] Field of Search ..... 72/353.4, 353.6, 72/370.05, 370.19; 29/454

[56] References Cited

U.S. PATENT DOCUMENTS

| | | | |
|---|---|---|---|
| 1,270,402 | 6/1918 | Fulton | 29/454 |
| 1,614,563 | 1/1927 | Leach et al. | 72/370.19 |
| 5,396,789 | 3/1995 | Castellon | 72/353.6 |
| 5,461,767 | 10/1995 | Okubo | 29/454 |

*Primary Examiner*—Lowell A. Larson
*Attorney, Agent, or Firm*—Brown & Wood, LLP

[57] ABSTRACT

A method of manufacturing a corrugated metallic pipe, including inserting into a smooth cylindrical metallic pipe a first mandrel having an axially extending corrugation having a predetermined shape and height, and radially expanding the first mandrel against cheek means, which surrounds the pipe and has a corrugation at least approximately corresponding to the corrugation of the first mandrel, to provide a first preformed corrugation on the metallic pipe, thereafter, inserting into the pipe with the first preformed corrugation, a second mandrel having an outer diameter corresponding to an inner diameter of the first corrugation, thereafter, radially displacing into corrugation hollows disc-shaped, axially spaced from each other, jaws which surround the pipe with the first preformed corrugation, and axially displacing the jaws toward each other, effecting folding up of the first preformed corrugation to obtain a final predetermined corrugation of the pipe.

5 Claims, 3 Drawing Sheets

METHOD OF MANUFACTURING A CORRUGATED METALLIC PIPE AND CORRUGATED PIPE PRODUCED BY THE METHOD

RELATED APPLICATIONS

This application is a continuation-in-part of application Ser. No. 08/694,018 filed Aug. 8, 1996, now abandoned.

BACKGROUND OF THE INVENTION

1. Field of the Invention

The present invention relates to a method of manufacturing a corrugated metallic pipe and which includes providing a mandrel having an axially extending corrugation having a predetermined shape and height, and inserting the mandrel into a smooth cylindrical metallic pipe and radially expanding the mandrel against cheek means, which surrounds the pipe and has a corrugation at least approximately corresponding to the corrugation of the mandrel, to provide a corrugation on the metallic pipe. The present invention also relates to a corrugated pipe formed by method.

2. Description of the Prior Art

The prior art discloses a plurality of methods and tools for manufacturing corrugated metallic pipes. Such methods and tools are disclosed, e.g., in German patents Nos. 3,035,234; 2,851,944; 2,909,142; 3,224,308; German publications DE-AS 2,407,226; DE-05 2,027,638; DE-OS 3,004,838; European Patent No. 298,852, French Patent No. 2,176,707, British patent publication No. 2,268,429; and U.S. Pat. No. 1,890,039.

According to German patent No. 3,035,234, a shaft with a plurality of corrugation discs supported thereon is inserted into a to-be-corrugated pipe, with the pipe being acted upon from outside by another plurality of corrugation discs, which correspond to the corrugation discs provided inside the pipe but are offset relative to the inside corrugation discs. The outer corrugation discs are likewise mounted on a shaft. The rotatable discs are displaced simultaneously toward each other and are axially displaced on their respective shafts. This method is inapplicable to forming corrugations on pipes with a small cross-section because the corrugation discs carrying shafts should be very strong and, thus, should have increased dimensions so that they would not be deformed by an operational pressure generated during the formation of the pipe corrugation.

According to German Publication DE-AS 2,407,226, a smooth cylindrical pipe is inserted into a matrix having a corrugated wall. Then, an elastic pressing member is inserted into the pipe and is compressed from opposite sides with dies, with the pipe being sectionally deformed. This method is very expensive and is applicable to forming corrugations only in pipes having thin walls.

The German patent publication DE-OS 2,027,638, which corresponds to British patent No. 1,341,774, discloses inserting into a to-be-corrugated pipe of a radially expandable mandrel, with sector-shaped discs acting on the pipe from outside, with the discs being displaced radially against the pipe. The desired corrugation is obtained by simultaneous actions of the inner mandrel and the outer discs.

According to German patents Nos. 2,851,944 and 2,909,142, the final corrugation is formed by forming one corrugation after another by applying inner pressure. This method and a tool for effecting the method are very expensive. However, the advantage of this method in comparison with the previously described methods consists in that the wall thickness of the pipe remains substantially unchanged in the corrugation region.

German patent No. 3,224,308 discloses a tool with which a corrugation hollow is formed on a cylindrical pipe step by step. Shaped members are placed into the corrugation hollows of the preformed pipe from outside. Then, a high hydraulic pressure is generated inside of the pipe subjecting the pipe to an axial pressure force which shortens the pipe, whereby the pipe sections, which lie between the hollows supported by the shaped members are displaced outwardly. This method is likewise very expensive.

According to European Patent No. 298,832, a radially expandable corrugated mandrel is inserted into a to-be-corrugated pipe. Sector-shaped cheek plates having a corrugation corresponding to the mandrel corrugation act on the pipe hammering it. The so obtained corrugation has a wall thickness which, because of stretching of the pipe in the corrugation region, is thinner than the thickness of the non-deformed wall.

French Patent No. 2,176,707 likewise discloses a radially expandable corrugated mandrel. As outer jaws, a plurality of gears, which surround the pipe, are used. The gears are so arranged that they coincide with the mandrel corrugation. The gears are supported on a slide displaceable along the pipe. With this arrangement, thinning of the pipe material in the corrugation region is also unavoidable.

British publication No. 2,268,429 discloses a radially expandable mandrel divided in an axial direction into a plurality of discs the outer surfaces of which form a corrugation. From the outside, the pipe is surrounded with sector-shaped disc-like jaws which, together with the mandrel, form the pipe corrugation. A similar method is disclosed in U.S. Pat. No. 1,890,039.

German patent publication No. 3,004,838 discloses a method for producing a corrugated pipe with a distinctive transverse corrugation. The device for forming the corrugation includes a plurality of axially spaced jaws. A to-be-corrugated pipe is inserted into the device, with the outer surface of the pipe engaging the jaws. After the pipe is inserted, it is sealed at its opposite ends, and a high hydrostatic pressure is generated in the interior of the pipe, causing bulging of the pipe sections located between the spaced jaws. Then, press pistons are applied while the high hydrostatic pressure is maintained inside the pipe. This causes folding of the bulged pipe sections. During application of the high hydrostatic pressure in the interior of the pipe, the axial sections of the pipe, which engage the jaws, are stretched out. This causes thinning of the wall in the region of these axial sections resulting in their weakening. During the subsequent axial displacement of the jaws, while the high hydrostatic pressure is maintained, which is necessary not only for further displacement outward of the pipe bulging sections but also for providing an adequate fiction force between the jaws and the pipe sections which engage them, the wall thickness of the jaw engaging pipe sections is further reduced. Thus, the finished corrugated pipe has a smallest wall thickness in the regions of the corrugations hollows. The above-mentioned friction force should be sufficiently high in order to prevent sliding of the jaws relative to the pipe during displacement of the jaws against the small bulge sections of the pipes, which are located between the jaws, which sliding would not permit to obtained a corrugation with predetermined dimensions. Generally, such corrugated pipes are used with steering columns of motor vehicle and serve as intermediate energy-absorbing elements during an accident. The corrugated pipes, which are located inside of the steering columns, serve for transmitting a rotational torque in steering motor vehicles. The corrugated pipe, which is produced with the above-discussed method have the smallest wall thickness in its interior region, and it is this region which is subjected to the highest stress during the transmission of the rotational torque. Therefore, for forming corrugated pipes used in steering columns, pipes with an increased wall thickness are selected so that the corrugated pipe is not subjected to inadmissible stress even in its inner region which is subjected to the highest stresses.

Accordingly, an object of the present invention is a method of manufacturing corrugated pipes with a very distinctive corrugation in which the wall thickness of the corrugated pipe in its interior region is not only retained but is rather increased.

Another object of the invention is a method of manufacturing of a corrugated pipe in which the ratio of a height of a single corrugation protrusion to a length of the corrugation protrusion is approximately 1:1.

SUMMARY OF THE INVENTION

These and other objects of the invention, which will become apparent hereinafter, are achieved by providing a method of manufacturing a pipe having a predetermined corrugation and which includes providing a plurality of first mandrel having each an axially extending corrugation having a predetermined shape and height, with the heights of the first mandrels progressively increasing from one first mandrel to another first mandrel, inserting the first mandrels into a smooth cylindrical metallic pipe, radially expanding the first mandrels against exchangeable complementary cheek means, and displacing the complementary check means, which surrounds the pipe and has a corrugation at least approximately corresponding to the corrugation of the inserted first mandrel, radially inward to provide a first preformed corrugation on the metallic pipe. Thereafter, a second mandrel having an outer diameter corresponding to an inner diameter of the first corrugation is inserted into the pipe having the first preformed corrugation. Thereafter, disc-shaped, axially spaced from each other, jaws, which surround the pipe with the first preformed corrugation, are radially displaced into corrugation hollows and then are axially displaced toward each other, effecting folding up of the first, preformed corrugation to obtain a final predetermined corrugation of the pipe.

The method according to the present invention permits to eliminate the drawbacks of a corrugated pipe, which is produced by the method disclosed in German Publication No. 3,004,838, with simple means. By using a multi-step formation of the pipe corrugation with a plurality of tool elements having appropriate shapes and dimensions, a very distinctive corrugation is formed in which the wall thickness of the interior region is not only retained but is even increased. This results from pressing inward of the small inner corrugation hollows which leads to the reduction of the inner diameter in comparison with the diameter of the initial cylindrical pipe, which results in material accumulation. The distinctive corrugation results in such deformation of the inner region in the area of small inner hollows that their flanks are sharply inclined, with the mean flank angle being at least 45° and, preferably, 65°. During subsequent folding, a simple tool can so support the inner region that during the pleating or folding step, the pipe sections located between the jaws are not subjected to any significant inner pressure. The jaws engage in the little folded hollows and are not displaced therefrom during their subsequent axial displacement. A reliable form-locking connection is provided between the foldable pipe corrugation and the outer jaws which insures a reliable retention of the pipe sections, which are located between the jaws, during the axial displacement of the jaws, without a need to provide an outwardly acting pressure inside the pipe.

The present invention permits to produce corrugated pipes which have, in their inner circular region, a wall thickness greater than the wall thickness of the smooth cylindrical pipe, which make the so produced corrugated pipes especially suitable for their designated purpose, as they have an increased thickness in the region where the highest stresses are generated during the transmission of the rotational torque.

In order to transform the preformed corrugation into the predetermined distinctive corrugation, the jaws are arranged pairwise in a plurality of parallel planes, and each jaw has a semi-circular recess, the limiting surface of which has a stepped profile with the step height corresponding to the height of the predetermined corrugation.

BRIEF DESCRIPTION OF THE DRAWINGS

The features and objects of the present invention will become more apparent, and the invention itself will be best understood from the following detailed description of the preferred embodiments when read with reference to the accompanying drawings, wherein.

DETAILED DESCRIPTION OF THE PREFERRED EMBODIMENTS

Figure 1:
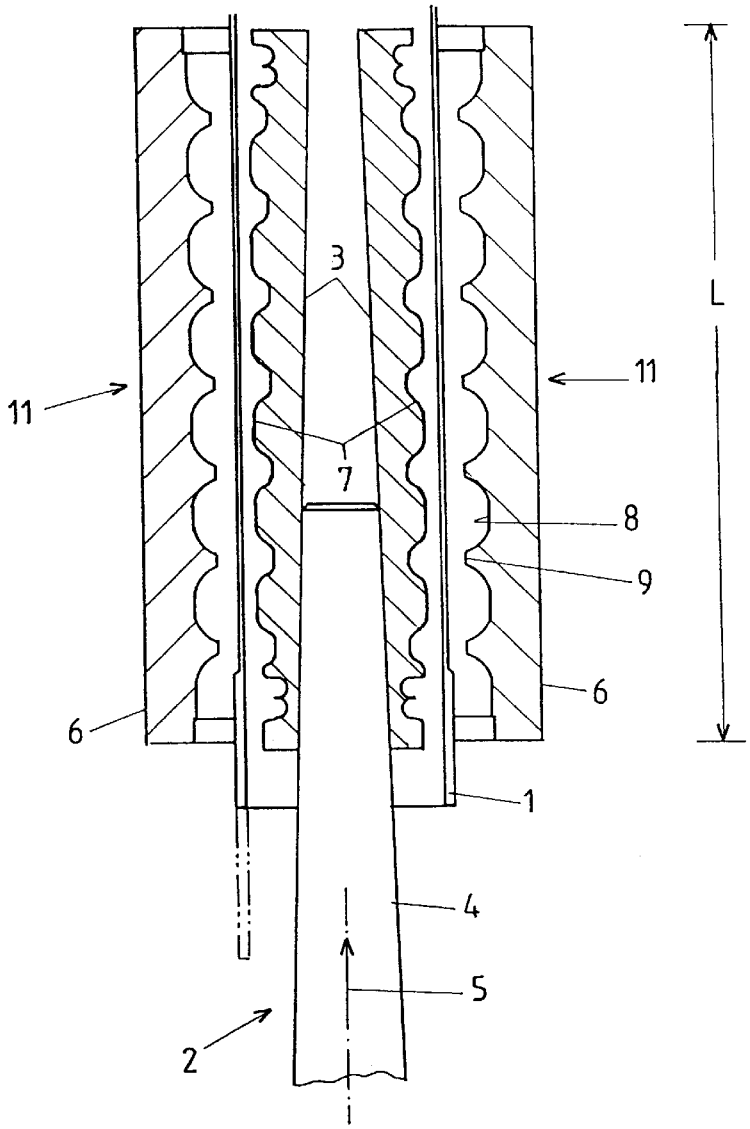
FIG. 1 is a longitudinal vertical cross-sectional view of a tool according to the present invention for preforming corrugations on a pipe.
Figure 3:
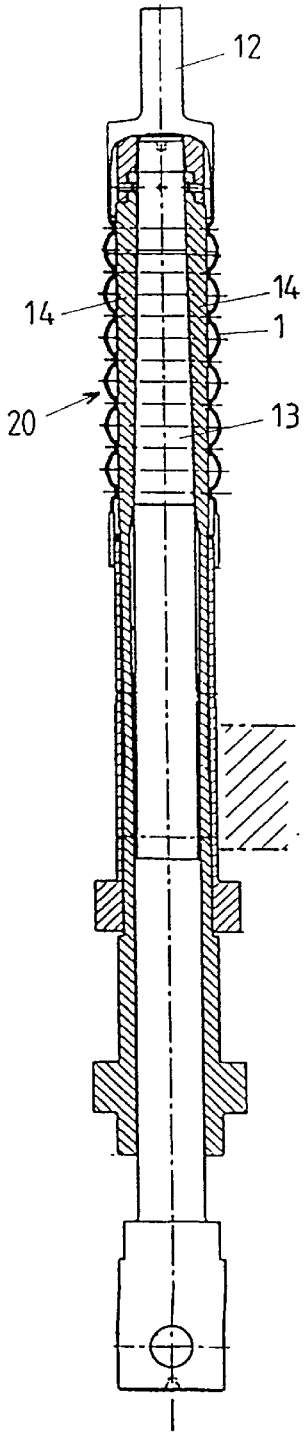
FIG. 3 is a longitudinal vertical cross-sectional view of a mandrel for supporting the pipe with the preformed corrugation thereon.

According to the present invention, manufacturing of corrugated metallic pipes is effected as follows. A mandrel 2 is inserted into a smooth cylindrical pipe 1. Two mandrels 2 are inserted into the pipe 1 from opposite sides. However, often the mandrel 2 can be inserted only from one side. The mandrel 2 is formed of a plurality of sector-shaped sections 3 between which, for effecting a radial expansion, a wedge-shaped shaft 4 is introduced (in a direction indicated with arrow 5). For holding the pipe 1, there are provided outer cheeks 6 which are likewise sector-shaped. Along their length L, both the outer cheeks 6 and the sections 3 are provided, on their adjacent sides, with cophasal, substantially identically formed corrugations 7 and 8, with the corrugation trains having relatively small hollows and relatively elongate crests.

Such a tool can be used only when several similar tools are used in a manufacturing process. Separate tools distinguish from each other by the shape of their corrugations. The first tool has a relatively small corrugation, i.e., a corrugation with a small height, with the corrugation height increasing from a tool to a following tool. For the sake of simplicity and clarity, only one corrugating tool is shown in the drawings.

Figure 2:
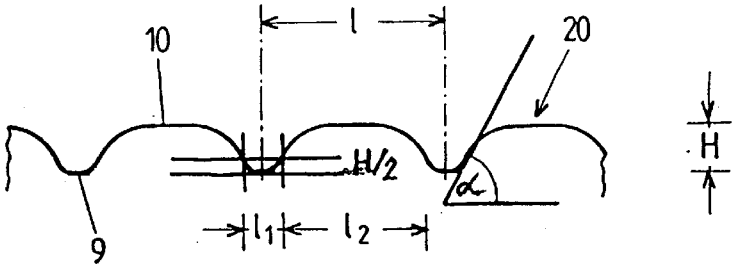
FIG. 2 is a view showing the preformed corrugations.

The smooth surface of the pipe 1, which lies between the mandrel 2 and the outer cheeks 6, is deformed by the radial expansion of the mandrel 2 and by the radial displacement of the cheek 6 toward the mandrel 2 (in the direction of arrow 11). Thereby, the pipe 1 is provided with the corrugations along the length L which distinguish from tool to tool until they acquire the shape shown in FIG. 2 at an increased scale. FIG. 2 shows that the corrugations hollows 9 are relatively small and the corrugation crests 10 have a relatively large extent. With the corrugation 20 shown in FIG. 2, the corrugation length L exceeds the corrugation height H by several times, e.g., by three to four times. With such shape of the corrugation 20, the length L, of the corrugation hollow 9, which is directed toward the pipe inside, constitute only a fraction of the length $l_2$ of the outwardly directed corrugation crest 10. This ratio, e.g., amounts to about from 0.3 to 0.6, with the lengths $l_1$, $l_2$ being measured at the half of the corrugation height H. The corrugation hollow 9 is shaped so and has such a depth that the mean flank angle $\alpha$ is at least 45° and, preferably, 60° and more.

The corrugation 20 shown in FIG. 2 is produced in several operational steps with several tools. The separate tools so differ from each other that the corrugation is formed with ever increasing complementing surface of the tools, i.e., the corrugation height H increases from one tool to another, with the flank angle becoming steeper and steeper. As a rule, a double increase in dimensions of a set of tools is sufficient. With such a formation of the corrugations shown in FIG. 2, not only the wall thickness of the pipe 1 remains substantially unchanged, but it even increases in the bottom regions of the corrugation hollows 9. The increase of the thickness in these regions results from the flow of material toward the interior of the pipe which is caused by the displacement of the cheek 6 radially against the pipe 1.

Such preformed pipe 1 which, in the example shown in the drawings, is closed at one end and has, at that closed end, an extension 12. The preformed pipe 1 is placed on a cylindrical mandrel 13 having a smooth outer surface. The mandrel 13 is formed, preferably, in the same way as the mandrel 2 shown in FIG. 1, but with the separate sector-shaped sections having, as it has already been mentioned above, smooth surfaces. The mandrel 13 is expanded radially, by introducing a wedge-shaped shaft, to such an extent that its outer diameter contacts the inner diameter of the corrugations 20, i.e., the inner surfaces of the corrugation hollows 9 of the preformed pipe 1 lie on the smooth cylindrical outer surface of the mandrel 13.

Figure 4:
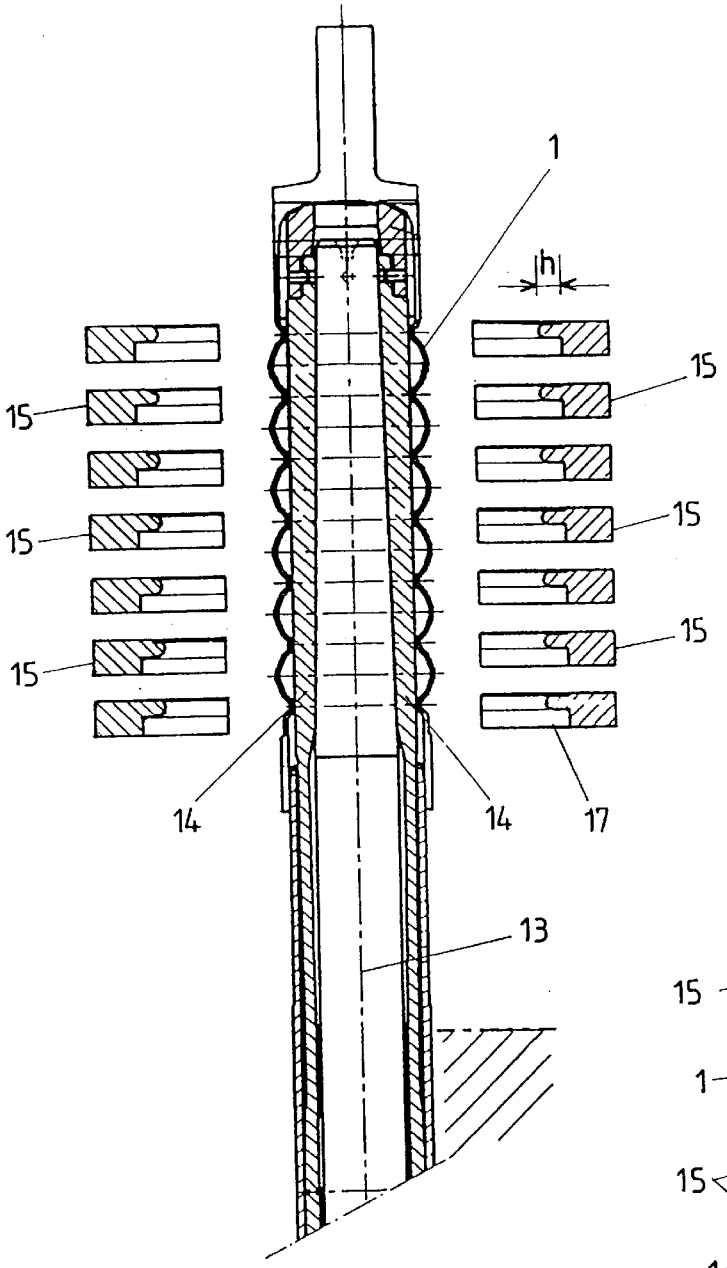
FIGS. 4–6 is a longitudinal vertical cross-sectional view similar to that of FIG. 3 but with the jaws occupying different positions during the manufacturing process.
Figure 5:
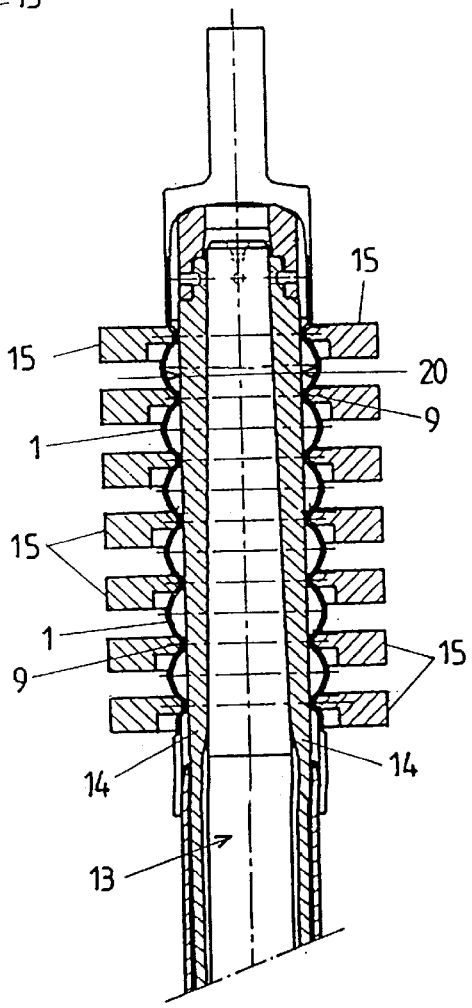
Figure 6:
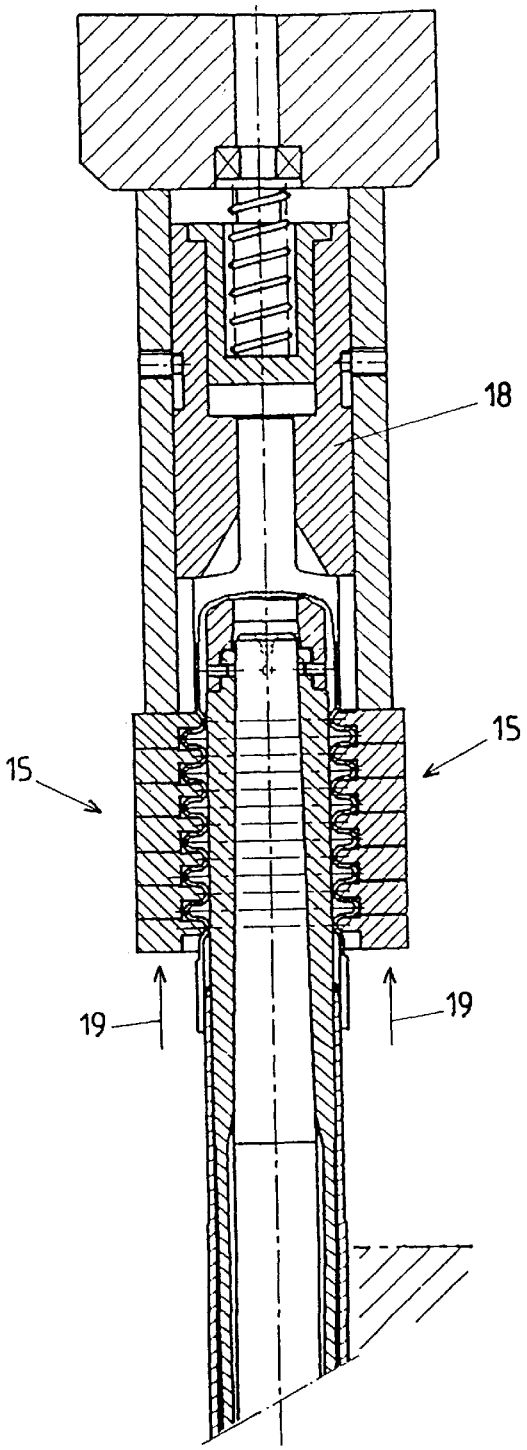
Figure 7:
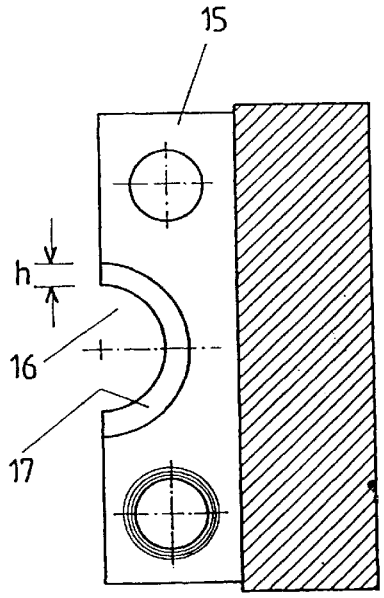
FIG. 7 is a plan view of a jaw.

The mandrel 13 is arranged between jaws 15 as shown in FIGS. 4–6. A plan view of a jaw 15 is shown in FIG. 7. The jaws 15 lie in a plurality of planes and are arranged pairwise with respect to the mandrel 13, as shown in FIG. 4. Each of the jaws 15 has a semi-circular recess 16 limited by a stepped surface 17, with the height h of the step corresponding to at least the height to which the preformed corrugation, which is shown in FIG. 2, should be corrugated. By using appropriate guide and positioning means (not shown), the jaws 15 are so positioned that the projecting portions of the jaws 15 lie in the planes of the corrugation hollows 9 of the corrugations 20 of the pipe 1. These jaws 15 are displaced toward the mandrel 15, which extends through the pipe 1 (FIG. 5), so that the projecting portions of the jaws 15 extend into the corrugation hollows 9, with the jaws 15 encompassing the pipe 1. Because of the increased wall thickness of the corrugation hollows 9 and steep flanks, form-locking positions of the jaws 15 is obtained, which insures a following proper pleating, without any pressure being generated in the interior of the pipe 1. The mandrel 15 insures an adequate support for the corrugation hollows during pleating.

Finally, a die 18 is advanced against the uppermost jaw 15 and displaces the pairs of jaws 15, which are spaced from each other, toward each other, with the lowermost jaw 15 being supported by a stop designated with an arrow 19 (FIG. 6). By the mutual displacement of the jaws 15, first, the flat corrugation crests 10 fold up with a simultaneous reduction of the length l, forming a pipe with a very distinctive corrugation. A very distinctive corrugation, according to the present invention, is a corrugation with a ratio of a corrugation protrusion length to the corrugation protrusion height being approximately 1:1. Upon the corrugation having been formed, the die 18 is displaced upward, the jaws 15 are displaced sidewise away from the pipe 1, and the mandrel 13 is radially contracted by the wedge shaft being withdrawn therefrom. Then, the finished corrugated pipe 1 is taken off from the mandrel 13. The corrugated pipe 1 may represent a single pipe or be formed of several pipes inserted one into another.

As it have been discussed above, a corrugation pipe produced by the disclosed method has a corrugation with a ratio of a corrugation protrusion length to corrugation protrusion height of approximately 1:1 This ratio proved to be optimal for the intended use of the corrugation pipe as an intermediate energy-absorbing element of a steering column of a motor vehicle. Experiments have show that the corrugation pipe with the corrugation protrusions having the foregoing ratio is optimally deformed under a predetermined force.

Though the present invention was shown and described with reference to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A method of manufacturing a corrugated metallic pipe having a predetermined corrugation, comprising the steps of:

providing a plurality of first mandrels having each an axially extending corrugation having a predetermined shape and height, with the heights of the first mandrels progressively increasing from one first mandrel to another first mandrel but with a length of a corrugation protrusion of each of the first mandrels exceeding the height of each of the first mandrel in several times;

inserting one after another in a predetermined sequence each of the plurality of the first mandrels into a smooth cylindrical metallic pipe, radially expanding an inserted first mandrel against exchangeable complementary cheek means and displacing the complementary cheek means, which surrounds the pipe and has a corrugation at least approximately corresponding to the corrugation of the inserted first mandrel, radially inwardly into the pipe to provide a first preformed corrugation different from the predetermined corrugation of the pipe and having corrugation protrusions a length of which exceeds a height thereof in several times;

thereafter, inserting into the pipe, having the first preformed corrugation, a second mandrel having an outer diameter corresponding to an inner diameter of the first preformed corrugation;

thereafter, radially displacing into first corrugation hollows disc-shaped, axially spaced from each other, jaws which surround the pipe; and axially displacing the jaws toward each other, effecting folding up of the first, preformed corrugation to obtain the predetermined corrugation of the pipe, with a ratio of a length of a corrugation protrusion of the predetermined corrugation of the pipe to a corrugation protrusion height of the predetermined corrugation being about 1:1.

2. A method as set forth in claim 1, wherein a length of a corrugation hollow of the first preformed corrugation measured at a half of a corrugation height equals a fraction of a length of a corrugation crest of the first preformed corrugation.

3. A method as set forth in claim 1, wherein the length of the corrugation hollow equals from 0.3 to 0.6 of the length of the corrugation crest.

4. A method as set forth in claim 3, wherein the corrugation hollow has a flank angle of at least 45°.

5. A method as set forth in claim 4, wherein the flank angle is 65°.

* * * * *